US006484930B1

(12) United States Patent
Draghetti

(10) Patent No.: US 6,484,930 B1
(45) Date of Patent: Nov. 26, 2002

(54) RIGID HINGED-LID PACKET

(75) Inventor: Fiorenzo Draghetti, Medicina (IT)

(73) Assignee: G.D Societa' per Azioni, Bologna (IT)

( * ) Notice: Subject to any disclaimer, the term of this patent is extended or adjusted under 35 U.S.C. 154(b) by 211 days.

(21) Appl. No.: 09/662,288

(22) Filed: Sep. 14, 2000

Related U.S. Application Data

(63) Continuation of application No. PCT/IT99/00222, filed on Jul. 16, 1999.

(30) Foreign Application Priority Data

Jan. 21, 1999 (JP) ..... BO99A0029

(51) Int. Cl.[7] ..... B65D 43/16
(52) U.S. Cl. ..... 229/146; 229/160.1; 229/182.1
(58) Field of Search ..... 229/146, 160.1, 229/182.1; 206/268, 273

(56) References Cited

U.S. PATENT DOCUMENTS 5,097,948 A * 3/1992 Campbell ..... 229/146
5,143,282 A * 9/1992 Pham ..... 229/160.1
5,529,180 A * 6/1996 Paolucci et al. ..... 206/268
5,806,671 A 9/1998 Focke et al. ..... 206/268
5,896,984 A * 4/1999 Focke et al. ..... 206/273
6,276,600 B1 * 8/2001 Rigby ..... 229/160.1
6,302,322 B1 * 10/2001 Focke et al. ..... 229/160.1
6,311,834 B1 * 11/2001 Focke et al. ..... 229/160.1
6,370,846 B1 * 4/2002 Schoch et al. ..... 206/268

FOREIGN PATENT DOCUMENTS

DE 3615827 11/1987
DE 3615828 11/1987
DE 19718821 11/1998

* cited by examiner

*Primary Examiner*—Gary E. Elkins
(74) *Attorney, Agent, or Firm*—Ladas & Parry

(57) ABSTRACT

A rigid packet (1) with a hinged lid (5) for cigarettes (2) has a front wall (6) and a rear wall (7), each curving outwards and having a respective flat central portion (12) and two curved, preweakened lateral bands (17) connecting the relative flat central portion (12) to two flat lateral walls (8) of the packet (1) at respective sharp edges (9).

10 Claims, 3 Drawing Sheets

RIGID HINGED-LID PACKET

This is a continuation of application Ser. No. PCT/IT99/00222, filed Jul. 16, 1999.

TECHNICAL FIELD

The present invention relates to a rigid hinged-lid packet.

More specifically, the present invention relates to a rigid hinged-lid packet made from a flat preweakened blank of cardboard or similar.

A particularly advantageous application of the present invention is in the manufacture of packets of cigarettes, to which specific reference is made in the following description purely by way of example.

BACKGROUND ART

Rigid hinged-lid packets of cigarettes are normally in the form of a rectangular-section parallelepipedon, and comprise a front and a rear wall connected to two lateral walls at respective sharp longitudinal edges.

Rigid packets of the above type, i.e. in the form of a rectangular-section parallelepipedon, have several drawbacks on account of their non-anatomical shape and their tendency to cause rapid wear of clothing fabrics or similar with which they may come into contact.

A further drawback of rectangular-section parallelepiped packets lies in their relatively high rigidity in the regions of the relatively small side walls and adjacent right-angle corners as opposed to the relatively poor rigidity of the front and rear walls, which are easily deformed inwards when the external transparent wrapping is applied and made to shrink about the packet.

Owing to the above, the cigarettes inside the packet, instead of assuming a low-energy distribution inside the packet (the distribution having the lowest possible energy would be a distribution over a circle), are maintained in an extremely high energy distribution with the result that, when the packet is first opened, the extraction of the first cigarette from the front row of the packet is always rather difficult.

All the above drawbacks were at least in part overcome by bevelled edge and rounded edge packets of the types disclosed in EP-A-0204933 and EP-A-0205766 respectively. However, in general, these two types of packet need, for being manufactured with a relatively high precision, the use of special machines, such as those disclosed in EP-A-0205894 and EP-A-0200087, which are relatively slow in operation and are absolutely dedicated machines, i.e. cannot be used for manufacturing packets other than the above two types of packet.

All the above renders the above two types of packet very expensive to manufacture.

Moreover, apart from being expensive, the rounded edge packets have the further drawbacks that, in general, their cover does not close in a precise manner on their box portion owing to the difficulty to make two rounded profiles to coincide with one another, and the external transparent wrapping does not suit the external shape of the packet at the rounded corners of its bottom and top surfaces with the result that, at these rounded corners, rigid outwardly protruding tips are formed which are not only anaesthetic, but also cause rapid wear of clothing fabrics or similar with which they may come into contact.

DISCLOSURE OF INVENTION

It is an object of the present invention to provide a rigid hinged-lid packet designed to eliminate the aforementioned drawbacks.

In particular, it is an object of the present invention to provide a rigid hinged-lid packet, which:

- allows the relevant cigarette group to deform to a relatively low-energy distribution, thus making the extraction of the first cigarette from the packet easier;
- avoids causing rapid wear of clothing fabrics or similar with which it may come into contact; and
- may be manufactured in an economic, easy and fast manner by using packing machines which, apart for very minor modifications, are those which are used for manufacturing rectangular-section parallelepiped packets.

According to the present invention, there is provided a rigid hinged-lid packet substantially in the form of a rectangular parallelepipedon and comprising a front wall and a rear wall substantially parallel to each other, and two lateral walls parallel to each other and substantially perpendicular to said front wall and said rear wall; said front wall and said rear wall each being connected to each of said two lateral walls at a respective sharp edge; characterized in that said front wall and said rear wall each comprise a respective flat central portion, and two lateral bands preweakened by longitudinal weakening lines; each lateral band being curved with the concavity facing inwards to connect the relative central portion to the lateral wall at the relative said sharp edge.

BRIEF DESCRIPTION OF THE DRAWINGS

A non-limiting embodiment of the invention will be described by way of example with reference to the accompanying drawings, in which.

BEST MODE FOR CARRYING OUT THE INVENTION

Figures 1, 2, 3:
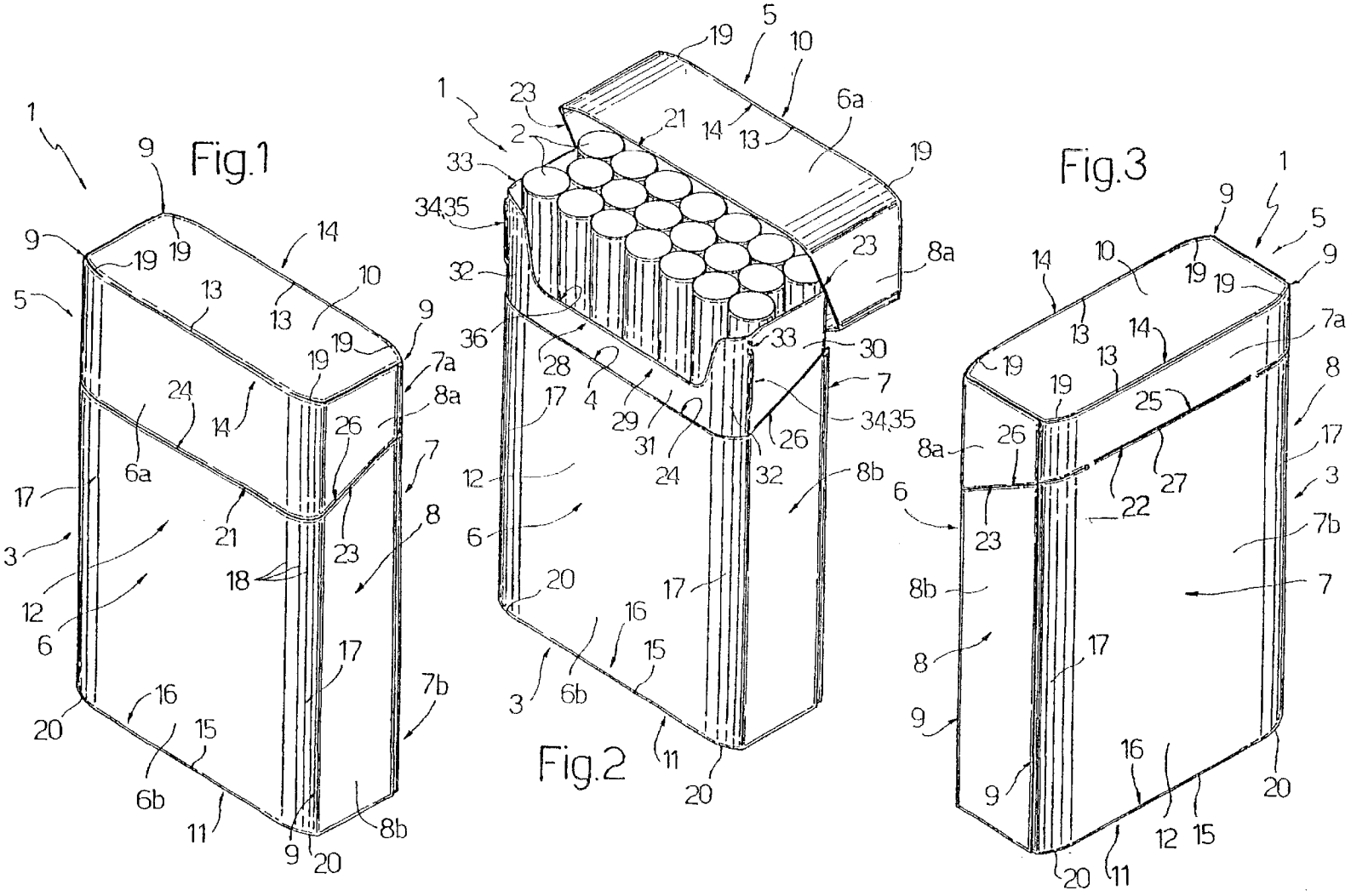
FIG. 1 shows a front view in perspective of a preferred embodiment of the packet according to the present invention in a closed configuration.
FIG. 2 shows a view in perspective of the FIG. 1 packet in an open configuration.
FIG. 3 shows a rear view in perspective of the FIG. 1 packet in the closed configuration.

Number 1 in FIGS. 1 to 5 indicates as a whole a packet housing a group of cigarettes 2 arranged in layers. In the example shown, the layers are three in number, the intermediate layer having one cigarette 2 less than the two outer layers.

Packet 1 comprises a cup-shaped bottom container 3 having an open top end 4; and a cup-shaped top lid 5 hinged to container 3 so as to rotate, with respect to container 3, between an open and a closed position respectively opening and closing end 4.

When lid 5 is closed, packet 1 is in the form of a substantially rectangular parallelepipedon defined by a front wall 6 and a rear wall 7 substantially parallel to each other and curving outwards; two lateral walls 8 parallel to each other, substantially perpendicular to walls 6 and 7, and connected to walls 6 and 7 at respective sharp edges 9; and a top wall 10 and a bottom wall 11 parallel to each other and perpendicular to walls 6, 7 and 8.

Each of walls 6 and 7 comprises a flat, substantially rectangular, central portion 12, which is defined at the top by a straight central portion 13 of a major lateral edge 14 of top wall 10, and is defined at the bottom by a straight central portion 15 of a major lateral edge 16 of bottom wall 11. Each of walls 6 and 7 also comprises two longitudinal lateral bands 17 located on opposite sides of relative central portion 12 and between portion 12 and a relative edge 9. Each band 17 is preweakened internally by longitudinal weakening lines 18 so as to curve with the concavity facing inwards, and comprises a top edge extending along a curved lateral portion 19 of major lateral edge 14 of top wall 10, and a bottom edge extending along a curved lateral portion 20 of major lateral edge 16 of bottom wall 11.

Figure 4:
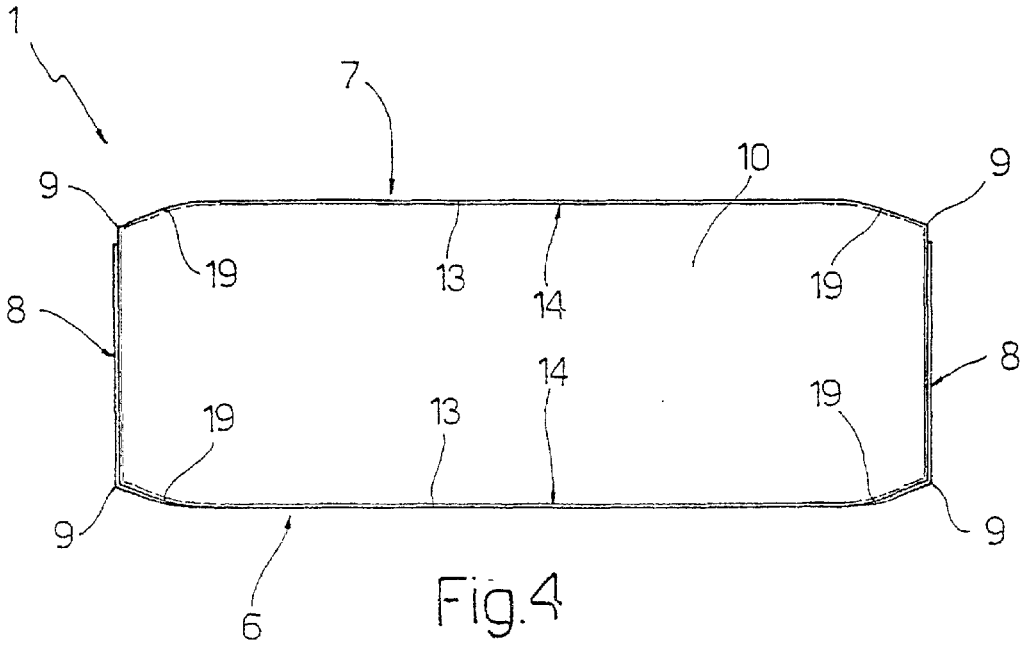
FIGS. 4 and 5 show respective top and bottom plan views of the FIG. 1 packet.
Figure 5:
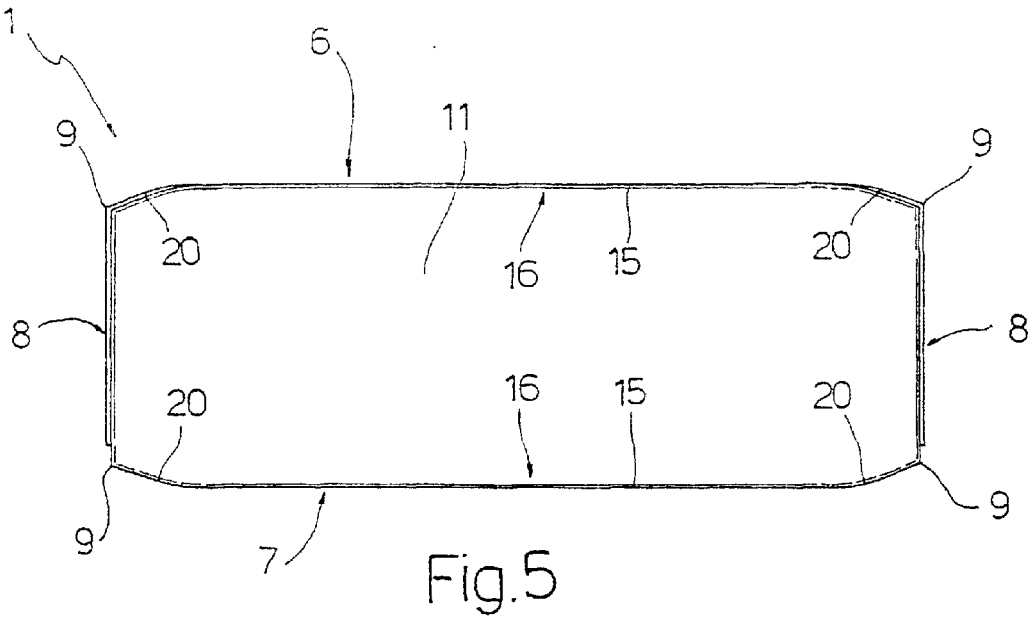

As such, and as shown clearly in FIGS. 4 and 5, the distance between central portions 12 of walls 6 and 7 is greater than the distance between edges 9 of each of walls 8.

Each wall 6, 7, 8 comprises a top portion indicated by the letter "a" and defining a corresponding wall of lid 5, and a bottom portion indicated by the letter "b" and defining a corresponding wall of container 3; top wall 10 defines the bottom wall of lid 5; and bottom wall 11 defines the bottom wall of container 3.

Walls 6*a*, 7*a*, 8*a* have respective free edges 21, 22, 23 facing respective free edges 24, 25, 26 of walls 6*b*, 7*b*, 8*b* when lid 5 is closed; and the portion of edge 22 associated with relative portion 12*a* is integral with the portion of edge 25 associated with relative portion 12*b* to define a hinge 27 by which to rotate lid 5 between said open and closed positions.

Packet 1 comprises a U-shaped collar 28 projecting partially outwards of end 4 and in turn comprising a front wall 29, which is integral with the inner surface of wall 6 and is connected to two lateral walls 30, each of which is integral with the inner surface of, and of the same width as, a respective wall 8. Wall 29 has a flat central portion 31 connected to the inner surface of flat central portion 12 of wall 6; and two curved preweakened lateral bands 32, each extending in contact with the inner surface of a respective band 17 of wall 6, and each connecting portion 31 to a respective wall 30 along a sharp longitudinal edge 33.

Each band 32 has a respective number of inner longitudinal weakening lines, and a longitudinal slit 34 is formed along each edge 33 to define in known manner a respective brake tab 35 which cooperates with an inner surface of lid 5 to keep lid 5 in the closed position. Wall 29 also comprises a central cavity 36 formed in portion 31 and facing lid 5.

Figure 6:
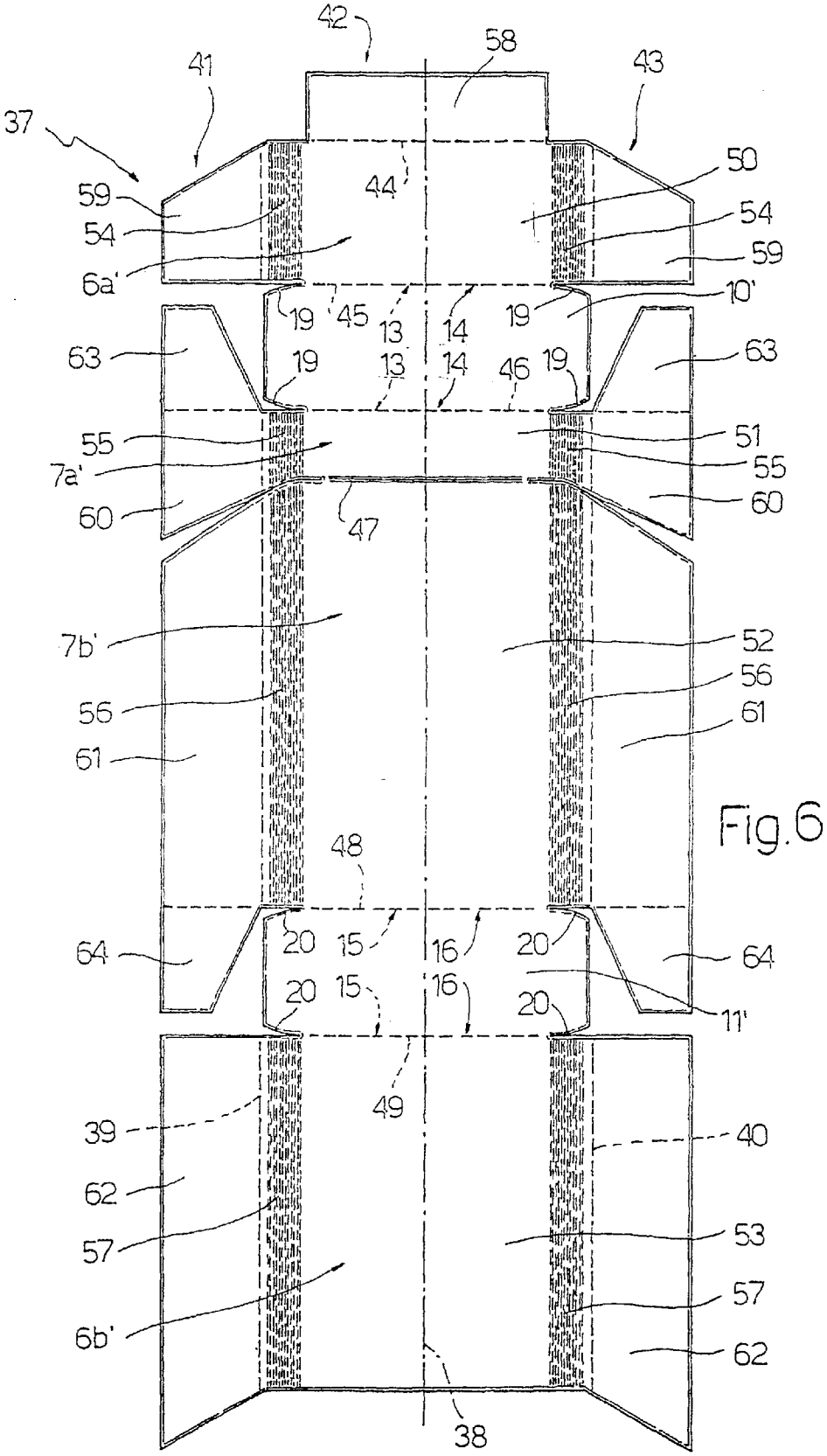
FIG. 6 shows a flat blank from which to form the FIG. 1 packet.

As shown in FIG. 6, packet 1 is formed from a flat blank 37 substantially in the form of an elongated rectangle, and the parts of which are indicated, wherever possible, using the same reference numbers, with superscripts, as for the corresponding parts of packet 1.

Blank 37 has a longitudinal axis of symmetry 38; and two preformed bend lines 39 and 40 on opposite sides of, and parallel to, axis 38 and which divide blank 37 into three side by side longitudinal strips 41, 42, 43 crossed by a number of preformed bend lines perpendicular to axis 38 and indicated 44 to 49.

Lines 44 to 49 define, on central strip 42, a panel 6*a*' extending between lines 44 and 45; a panel 10 extending between lines 45 and 46; a panel 7*a*' extending between lines 46 and 47; a panel 7*b*' extending between lines 47 and 48; a panel 11' extending between lines 48 and 49 and substantially identical to panel 10'; and an end panel 6*b*' connected to panel 11'.

Panel 10' is connected to panels 6*a*', and 7*a*' along respective central portions 13 of edges 14, the lateral portions 19 of which are detached from panels 6*a*' and 7*a*'. Similarly, panel 11' is connected to panels 6*b*' and 7*b*' along respective central portions 15 of edges 16, the lateral portions 20 of which are detached from panels 6*b*' and 7*b*'.

Panels 6*a*', 7*a*', 7*b*', 6*b*' comprise respective flat central portions 50, 51, 52, 53, each of which defines part of a respective central portion 12, and is substantially rectangular and of a width substantially equal to the length of central portions 13, 15 of edges 14, 16. Each of panels 6*a*', 7*a*', 7*b*', 6*b*' comprises two longitudinal lateral bands 54, 55, 56, 57, which are located on opposite sides of respective central portion 50, 51, 52, 52, and each of which comprises a respective portion adjacent to respective central portion 50, 51, 52, 53 and preweakened by longitudinal weakening lines, and a respective smooth outer portion extending along respective preformed bend line 39, 40.

Panel 6*a*' is connected along line 44 to a strengthening tongue 58 of substantially the same width as central portion 50.

Each of lines 39, 40 defines, outwards of panels 6*a*', 7*a*', 7*b*,'6*b*', respective substantially trapezoidal wings 59, 60, 61, 62; and each wing 60 has a substantially trapezoidal longitudinal appendix 63, which is joined to relative wing 60 along line 46, faces relative wing 59, and is of a maximum width equal to the width of each of lateral walls 8. Similarly, each wing 61 has a substantially trapezoidal longitudinal appendix 64, which is joined to relative wing 61 along line 48, faces relative wing 62, and is of a maximum width equal to the width of each of lateral walls 8.

Hinge 27 extends along line 47; wings 61 and 62 are folded squarely with respect to respective panels 7*b*'and 6*b*'; by rotating panels 6*b*' and 7*b*' squarely towards each other and with respect to panel 11', wings 61 are superimposed on wings 62, so that lateral bands 56 and 57 assume a curved configuration with respect to respective central portions 52 and 53 to form walls 6*b*', 7*b*', 8*b*' of container 3; and appendixes 64, once folded with respect to respective wings 61, and once rotated with wings 61 onto the inner surface of panel 11', define, with panel 11', the bottom wall 11 of packet 1.

Similarly, wings 59 and 60 are folded squarely with respect to respective panels 6*a*' and 7*a*'; by rotating tongue 58 onto the inner surface of panel 6*a*', and by rotating panels 6*a*' and 7*a*' squarely towards each other and with respect to panel 10', wings 59 are superimposed on wings 60 so that lateral bands 54 and 55 assume a curved configuration with respect to relative central portions 50 and 51 to form walls 6*a*, 7*a*, 8*a* of lid 5; and appendixes 63, once folded squarely with respect to relative wings 60, and once rotated with wings 60 onto the inner surface of panel 10', define, with panel 10', the top wall 10 of packet 1.

It should be pointed out that, upon completion of the above folding operation, lateral portions 19 of edges 14 of top wall 10 and lateral portions 20 of edges 16 of bottom wall 11 are positioned facing, but detached from, relative lateral bands 17.

The above folding operation of blank 37 therefore only provides for forming container 3 and lid 5, so that collar 28 must preferably be folded separately and then made integral with container 3.

I claim:

1. A rigid hinged-lid packet substantially in the form of a rectangular parallelepipedon and comprising a front wall (6) and a rear wall (7) substantially parallel to each other, and two lateral walls (8) parallel to each other and substantially perpendicular to said front wall (6) and said rear wall (7);

said front wall (6) and said rear wall (7) each being connected to each of said two lateral walls (8) at a respective sharp edge (9); characterized in that said front wall (6) and said rear wall (7) each comprise a respective flat central portion (12), and two lateral bands (17) preweakened by longitudinal weakening lines (18); each lateral band (17) being curved with the concavity facing inwards to connect the relative central portion (12) to the lateral wall (8) at the relative said sharp edge (9).

2. A packet as claimed in claim 1, characterized in that the distance between said central portions (12) is greater than the distance between the sharp edges (9) of each said lateral wall (8).

3. A packet as claimed in claim 1, characterized by comprising a first end wall (10) and a second end wall (11), each having two major lateral edges (14, 16); each said major lateral edge (14, 16) comprising respective curved lateral portions (19, 20) of the same shape as each of said lateral bands (17) viewed in cross section; said lateral portions (19, 20) extending along, but being detached from, respective axial ends of the respective lateral bands (17).

4. A packet as claimed in claim 1, characterized by comprising a cup-shaped bottom container (3) having an open top end (4); a cup-shaped lid (5) hinged to said open top end (4) to rotate between an open position and a closed position respectively opening and closing said container (3); and a collar (28) connected to said container (3) and projecting partially from said open top end (4).

5. A packet as claimed in claim 4, characterized by being formed from a substantially rectangular, flat blank (37) of cardboard or similar.

6. A packet as claimed in claim 5, characterized in that said blank (37) has two preformed longitudinal bend lines (39, 40), and a number of preformed transverse bend lines (44–49) defining, between said two preformed longitudinal bend lines (39, 40) and for both the lid (5) and the container (3), a front panel (6*a*', 6*b*'), an intermediate panel (10', 11'), and a rear panel (7*a*', 7*b*'); each of said front panels (6*a*', 6*b*') and rear panels (7*a*', 7*b*') having a flat central portion (50,53, 51, 52), and two lateral portions (54, 57, 55, 56) preweakened by longitudinal weakening lines.

7. A packet as claimed in claim 6, characterized in that each front panel (6*a*', 6*b*') has two opposite longitudinal lateral wings (59, 62), and each rear panel (7*a*', 7*b*') has two opposite longitudinal further lateral wings (60, 61); the further lateral wings (60, 61) of each rear panel (7*a*', 7*b*') having respective appendixes (63, 64) located on opposite sides of a relative intermediate panel (10', 11').

8. A packet as claimed in claim 7, characterized in that each said appendix (63, 64) is of a maximum width equal to the minimum height of the relative said intermediate panel (10', 11'); each appendix (63, 64) being superimposed on the relative intermediate panel (10', 11') to define a portion of the relative said first end wall (10) and second end wall (11) of the packet (1).

9. A packet as claimed in claim 6, characterized in that said blank (37) comprises a strengthening tongue (58) extending from said front panel (6*a*') and along the respective transverse bend line (44); said tongue (58) being of a width substantially equal to the width of the relative said central portion (50).

10. A packet as claimed in claim 4, characterized in that said collar (28) comprises a front wall (29) integral with said front wall (6) of the packet, and two further lateral walls (30) integral with respective said lateral walls (8) of the packet and engaging the lid (5) when the lid (5) is in the closed position; said front wall (29) of the collar comprising a flat central portion (31), and two lateral portions (32) preweakened by longitudinal weakening lines and curved with the concavity facing said rear wall (7); each said lateral portion (32) of the collar (28) connecting said central portion (31) of the collar (28) to a relative said further, lateral wall (30) at a respective further sharp edge (33); and the width of each further lateral wall (30) of the collar (28) being equal to the width of each said lateral wall (8) of the packet (1).

* * * * *

UNITED STATES PATENT AND TRADEMARK OFFICE

CERTIFICATE OF CORRECTION

PATENT NO. : 6,484,930 B1
DATED : November 26, 2002
INVENTOR(S) : Fiorenzo Draghetti It is certified that error appears in the above-identified patent and that said Letters Patent is hereby corrected as shown below:

Title page,
Item [*], "211" should read -- 213 --
Item [30], "JP" should read -- IT --.

Signed and Sealed this

Eighteenth Day of March, 2003

JAMES E. ROGAN
*Director of the United States Patent and Trademark Office*